US009053665B2

(12) United States Patent
Chen et al.

(10) Patent No.: US 9,053,665 B2
(45) Date of Patent: Jun. 9, 2015

(54) DISPLAY DEVICE AND CONTROL METHOD THEREOF WITHOUT FLICKER ISSUES

(75) Inventors: Tse-Yuan Chen, Chu-Nan (TW); I-Lin Wu, Chu-Nan (TW)

(73) Assignees: INNOCOM TECHNOLOGY (SHENZHEN) CO., LTD., Shenzhen (CN); INNOLUX CORPORATION, Jhu-Nan (TW)

( * ) Notice: Subject to any disclaimer, the term of this patent is extended or adjusted under 35 U.S.C. 154(b) by 187 days.

(21) Appl. No.: 13/479,064

(22) Filed: May 23, 2012

(65) Prior Publication Data

US 2012/0299976 A1 Nov. 29, 2012

Related U.S. Application Data

(60) Provisional application No. 61/490,540, filed on May 26, 2011.

(30) Foreign Application Priority Data

Aug. 9, 2011 (TW) ..... 100128302 A

(51) Int. Cl.
*G09G 3/32* (2006.01)

(52) U.S. Cl.
CPC ..... *G09G 3/3233* (2013.01); *G09G 3/3291* (2013.01); *G09G 2300/0819* (2013.01); *G09G 2300/0861* (2013.01); *G09G 2310/0262* (2013.01); *G09G 2310/067* (2013.01); *G09G 2320/0247* (2013.01); *G09G 2320/043* (2013.01)

(58) Field of Classification Search
CPC ..... G09G 3/30; G09G 3/32; G09G 3/3225; G09G 3/3233; G09G 3/325; G09G 3/3258; G09G 2300/0819; G09G 2300/0842; G09G 2300/0866; G09G 2300/0876; G09G 2320/0223; G09G 2320/0247; G09G 2320/0257; G09G 2320/0266
USPC ..... 345/690, 76–83
See application file for complete search history.

(56) References Cited

U.S. PATENT DOCUMENTS

| | | | | |
|---|---|---|---|---|
| 2006/0208977 | A1* | 9/2006 | Kimura | 345/76 |
| 2007/0268210 | A1* | 11/2007 | Uchino et al. | 345/55 |
| 2008/0088547 | A1* | 4/2008 | Chan et al. | 345/76 |
| 2009/0201231 | A1* | 8/2009 | Takahara et al. | 345/76 |

FOREIGN PATENT DOCUMENTS

| | | |
|---|---|---|
| TW | 200625241 | 7/2006 |
| TW | I276032 | 3/2007 |
| TW | 200820199 | 5/2008 |

* cited by examiner

*Primary Examiner* — Liliana Cerullo
(74) *Attorney, Agent, or Firm* — Liu & Liu

(57) ABSTRACT

A display device including a plurality of pixels and a driving module is disclosed. Each pixel stores voltage and displays brightness according to the stored voltage. The driving module updates the stored voltage during a frame period. The frame period includes a plurality of row times. Each row time includes at least one programming period and at least one emission period. The driving module de-activates the pixels to stop displaying brightness during the programming periods and activates the pixels to display brightness during the emission periods.

11 Claims, 7 Drawing Sheets

DISPLAY DEVICE AND CONTROL METHOD THEREOF WITHOUT FLICKER ISSUES

CROSS REFERENCE TO RELATED APPLICATIONS

This application claims the benefit of U.S. Provisional Application No. 61/490,540, filed on May 26, 2011, the entirety of which is incorporated by reference herein.

This Application claims priority of Taiwan Patent Application No. 100128302, filed on Aug. 9, 2011, the entirety of which is incorporated by reference herein.

BACKGROUND OF THE DISCLOSURE

1. Field of the Invention

The invention relates to a display device, and more particularly to a display device, which repeatedly lights pixels during a frame period.

2. Description of the Related Art

The new generation of flat panel devices, electroluminescent displays, for example organic light emitting diode (OLED) displays, have a thin profile, light weight, and high luminance efficiency. OLED displays can be classified as passive matrix organic light emitting diode (PM-OLED) and active matrix organic light emitting diode (AM-OLED) types, according their driving mode.

Generally, the AM-OLED type comprises a display panel. The display panel comprises a plurality of pixels. Each pixel at least comprises a driving transistor and a luminescence element. The luminescence element is lighted according to a driving current generated by the driving transistor. However, the driving transistors of the different pixels may comprise different threshold voltages due to manufacturing procedures. When the driving transistors with different threshold voltages receive the same image signal, the driving transistors may generate different driving currents such that the luminescence elements display different brightness.

To solve the problem, a conventional method provides a pixel comprising six transistors and a capacitor. However, the conventional method increases costs and results in a low aperture ratio.

BRIEF SUMMARY OF THE DISCLOSURE

In accordance with an embodiment, a display device comprises a plurality of pixels and a driving module. Each pixel stores voltage and displays brightness according to the stored voltage. The driving module updates the stored voltage during a frame period. The frame period comprises a plurality of row times. Each row time comprises at least one programming period and at least one emission period. The driving module de-activates the pixels to stop displaying brightness during the programming periods and activates the pixels to display brightness during the emission periods.

An exemplary embodiment of a control method for a plurality of pixels is described in the following. During a frame period, voltages of the pixels are updated. The frame period comprises a plurality of row times. Each row time comprises at least one programming period and at least one emission period. During the programming periods, the pixels are de-activated to stop displaying brightness. During the emission period, the pixels are activated to display brightness A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE DISCLOSURE

The following description is of the preferred mode of carrying out the invention. This description is made for the purpose of illustrating the general principles of the invention and should not be taken in a limiting sense. The scope of the invention is best determined by reference to the appended claims.

Figure 1:
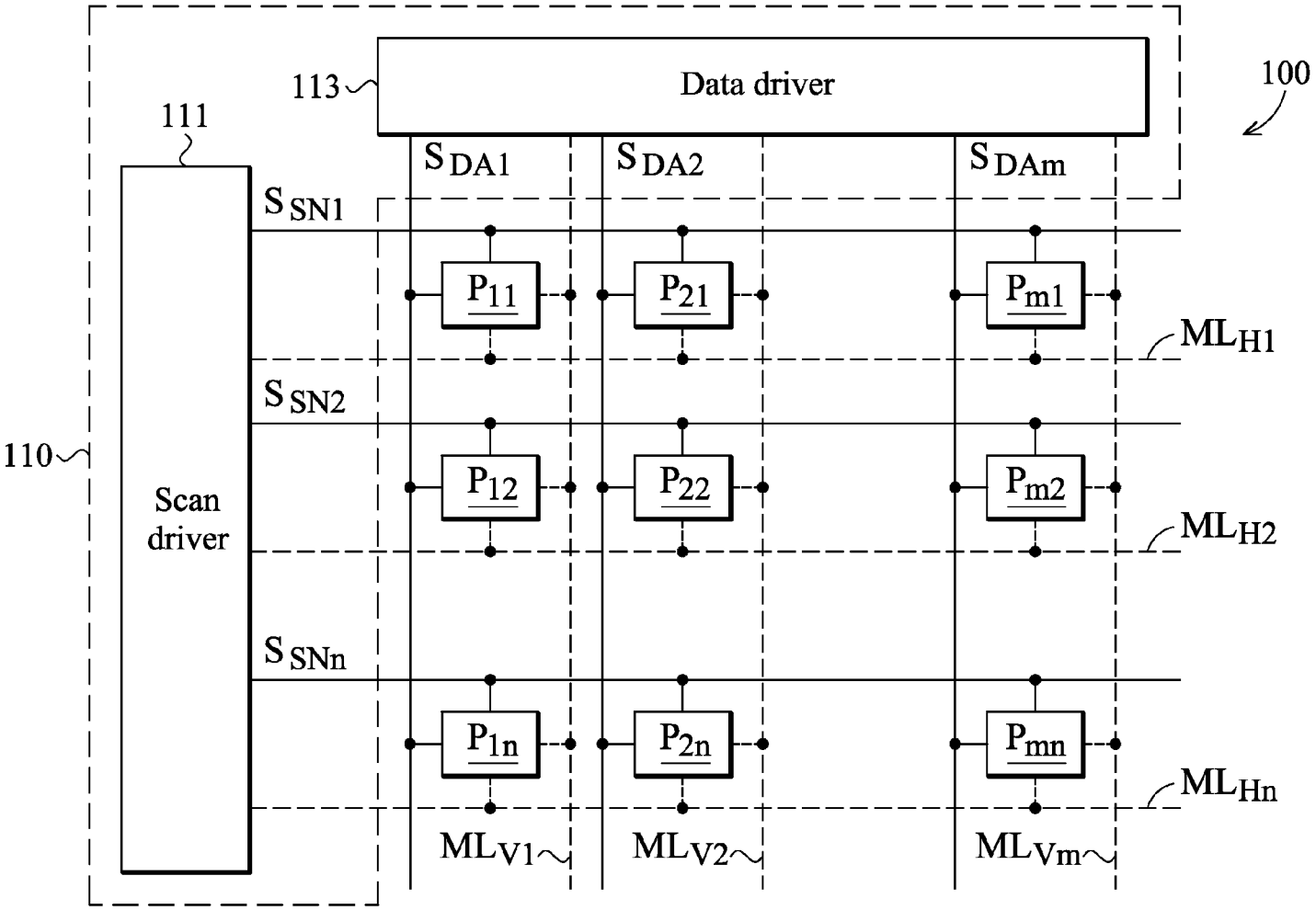
FIG. 1 is a schematic diagram of an exemplary embodiment of a display device.

FIG. 1 is a schematic diagram of an exemplary embodiment of a display device. The display device 100 comprises pixels $P_{11}$~$P_{mn}$ and a driving module 110. Each of the pixels $P_{11}$~$P_{mn}$ is capable of storing voltage and displays brightness according to the stored voltage. The driving module 110 updates the voltages stored in the pixels $P_{11}$~$P_{mn}$ and activates the pixels $P_{11}$~$P_{mn}$ to display brightness according to the original stored voltages or the updated voltages.

During a frame period, the driving module 110 updates all voltages stored in the pixels $P_{11}$~$P_{mn}$ and repeatedly activates the pixels $P_{11}$~$P_{mn}$ for displaying brightness. Since the pixels $P_{11}$~$P_{mn}$ repeatedly display brightness, a flicker issue does not occur to an image displayed by the display device 100 and a user does not discover the flicker issue.

In this embodiment, the driving module 110 comprises a scan driver 111 and a data driver 113. The scan driver 111 provides scan signals $S_{SN1}$~$S_{SNn}$ to the pixels $P_{11}$~$P_{mn}$. The data driver 113 provides data signals $S_{DA1}$~$S_{DAm}$ to the pixels $P_{11}$~$P_{mn}$. In addition, the scan driver 111 and the data driver 113 provide a plurality of control signals to the pixels $P_{11}$~$P_{mn}$ via metal lines $ML_{H1}$~$ML_{Hn}$ and $ML_{V1}$~$ML_{Vm}$. The voltages stored in the pixels $P_{11}$~$P_{mn}$ can be updated or the duration of displaying brightness can be controlled according to the control signals.

In other embodiments, the control signals are provided by the scan drive 111, the data driver 113 or other drivers, such as a timing controller (TCON). Additionally, each pixel can receive one or more control signals via one or more metal lines. As shown in FIG. 1, the pixels $P_{11}$~$P_{mn}$ receive the control signals provided by the scan drive 111 and the data driver 113 via the metal lines $ML_{H1}$~$ML_{Hn}$ and $ML_{V1}$~$ML_{Vm}$, but the disclosure is not limited thereto.

Figure 2A:
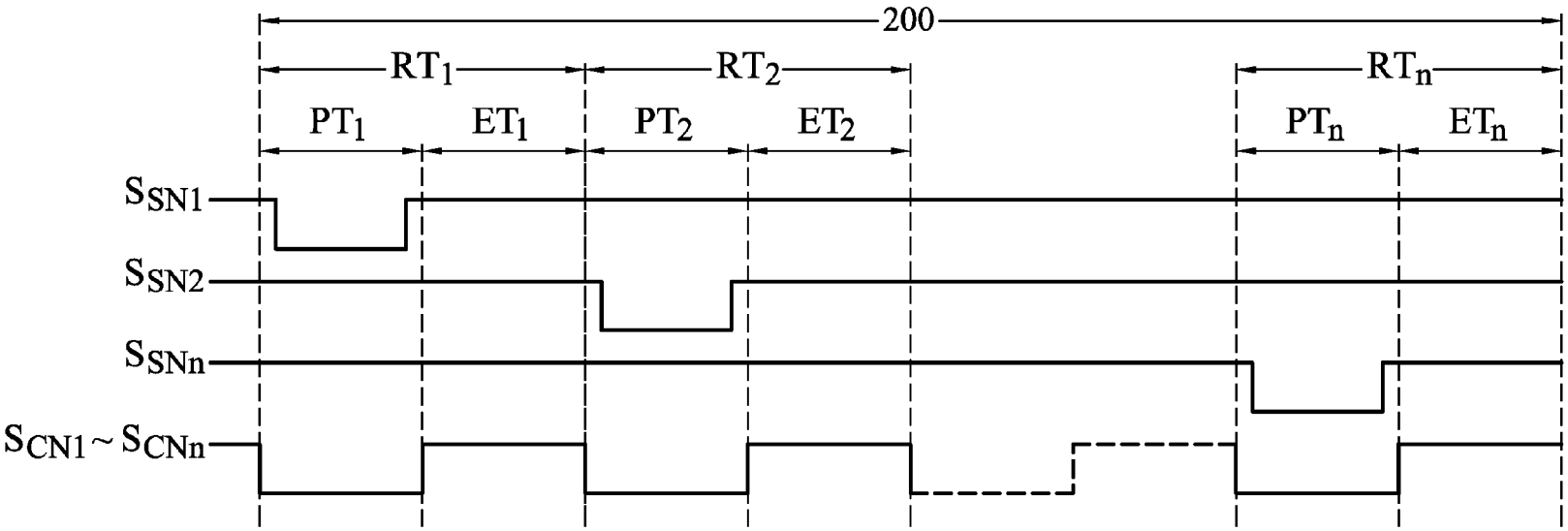
FIG. 2A is a timing schematic diagram of an exemplary embodiment of the display device.

FIG. 2A is a timing schematic diagram of an exemplary embodiment of the display device. In FIG. 2A, the frame period 200 comprises row times $RT_1$~$RT_n$. Each of the row times $RT_1$~$RT_n$ comprises a programming period and an emission period. During the programming periods $PT_1$~$PT_n$, the pixels $P_{11}$~$P_{mn}$ are de-activated, thus, the pixels $P_{11}$~$P_{mn}$ stop displaying brightness. During the emission periods $ET_1$~$ET_n$, the pixels are activated, thus, each of the pixels $P_{11}$~$P_{mn}$ displays a corresponding brightness according to the stored voltage. Since the pixels $P_{11}$~$P_{mn}$ repeatedly display brightness, a flicker issue does not occur in the image displayed by the display device 100. In this embodiment, during the programming periods $PT_1$~$PT_n$, the voltages stored in the pixels of a row are updated. In the same row time, the programming period occurs before the emission period.

Taking the row times $RT_1$ and $RT_2$ as an example, during the programming period $PT_1$, the pixels $P_{11}$~$P_{mn}$ are de-activated such that the pixels $P_{11}$~$P_{mn}$ stop displaying brightness. During the programming period $PT_1$, the voltages stored in the pixels $P_{11}$~$P_{m1}$ of a first row are updated. In this embodiment, the pixels $P_{11}$~$P_{m1}$ of the first row are coupled to a first scan electrode to receive a scan signal $S_{SN1}$. The pixels $P_{11}$~$P_{m1}$ store voltages and updates the stored voltage according to the scan signal $S_{SN1}$. Then, during the emission period $ET_1$, the pixels $P_{11}$~$P_{mn}$ are activated for displaying brightness. During the emission period $ET_1$, the pixels $P_{11}$~$P_{m1}$ of the first row display brightness according to the updated voltage and other pixels of other rows display brightness according to the original stored voltages.

Then, during the programming period $PT_2$, the pixels $P_{11}$~$P_{mn}$ are de-activated such that the pixels $P_{11}$~$P_{mn}$ stop displaying brightness. During the programming period $PT_2$, the voltages stored in the pixels $P_{12}$~$P_{m2}$ of a second row are updated. In this embodiment, the pixels $P_{12}$~$P_{m2}$ of the second row are coupled to a second scan electrode to receive a scan signal $S_{SN2}$. The pixels $P_{12}$~$P_{m2}$ store voltages and updates the stored voltage according to the scan signal $S_{SN2}$. Then, during the emission period $ET_2$, the pixels $P_{11}$~$P_{mn}$ are activated such that the pixels $P_{11}$~$P_{mn}$ display brightness. During the emission period $ET_2$, the pixels $P_{12}$~$P_{m2}$ of the second row display brightness according to the updated voltage and other pixels of other rows display brightness according to the stored voltages.

Thus, during the frame period 200, the driving module 110 can update all voltages stored in the pixels $P_{11}$~$P_{mn}$. Furthermore, the invention does not limit how the driving module 110 activates or de-activates the pixels $P_{11}$~$P_{mn}$. In this embodiment, the driving module 110 utilizes the control signals $S_{CN1}$~$S_{CNn}$ to activate or de-activate the pixels $P_{11}$~$P_{mn}$. For example, when the control signals $S_{CN1}$~$S_{CNn}$ are at a low level, the pixels $P_{11}$~$P_{mn}$ are de-activated. Thus, the pixels $P_{11}$~$P_{mn}$ stop displaying brightness. On the contrary, when the control signals $S_{CN1}$~$S_{cm}$, are at a high level, the pixels $P_{11}$~$P_{mn}$ are activated. Thus, the pixels $P_{11}$~$P_{mn}$ are lighted to display a corresponding brightness.

As shown in FIG. 2A, during each row time, the voltages stored in the pixels of a row are updated, but the disclosure is not limited thereto. In another embodiment, during each row time, the voltages stored in the pixels of two rows are updated.

Figure 2B:
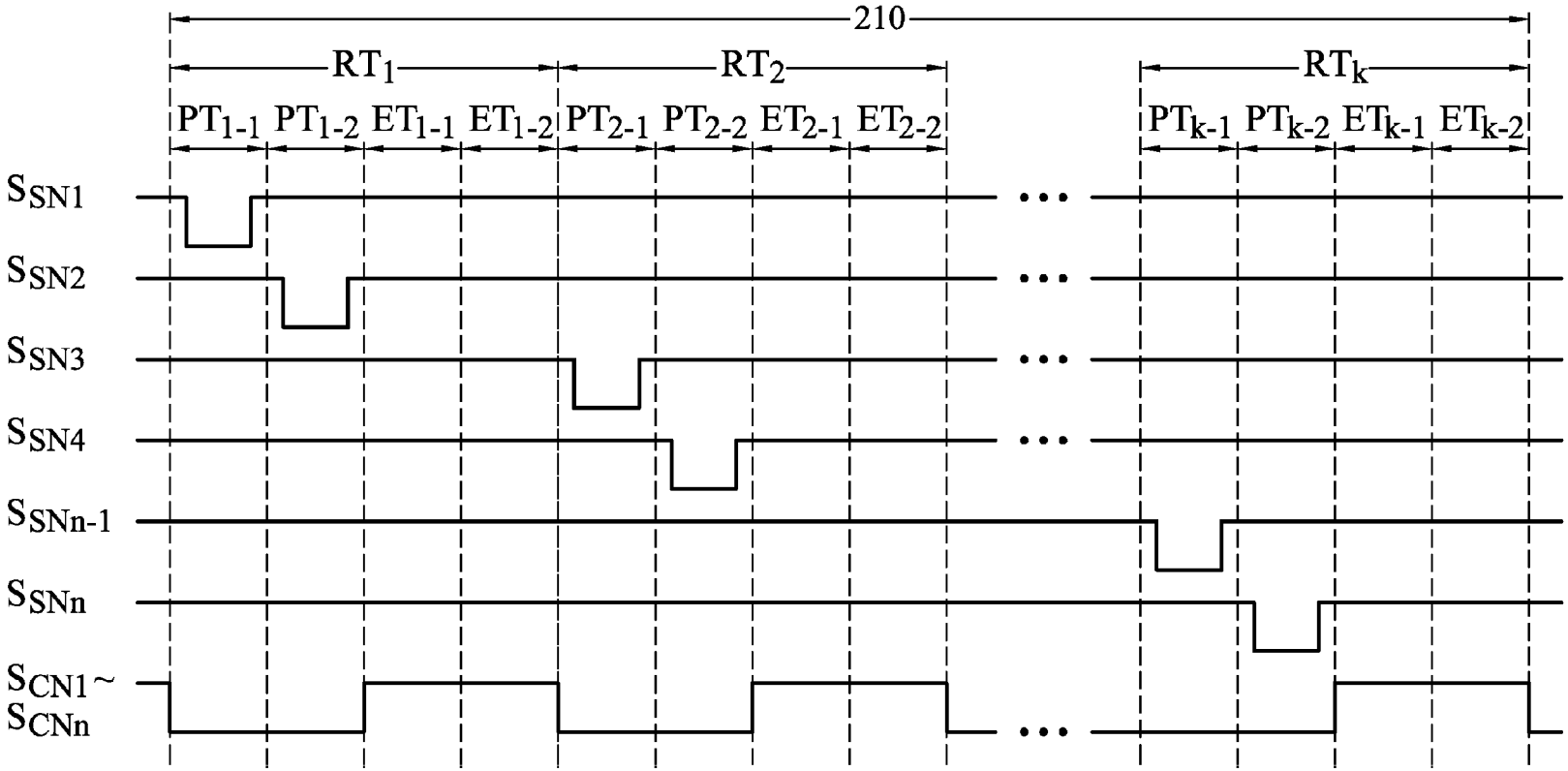
FIG. 2B is a timing schematic diagram of another exemplary embodiment of the display device.

In FIG. 2B, a frame period 210 comprises row times $RT_1$~$RT_k$. Each of the row times $RT_1$~$RT_k$ comprises two programming periods and two emission periods. Since the operations of row time $RT_1$~$RT_k$ are the same, the row time $RT_1$ is given as an example.

The row time $RT_1$ comprises programming periods $PT_{1-2}$ and emission periods $ET_{1-1}$ and $ET_{1-2}$. The programming period $PT_{1-1}$ occurs before the programming period $PT_{1-2}$. The programming period $PT_{1-2}$ occurs before the emission period $ET_{1-1}$. The emission period $ET_{1-1}$ occurs before the emission period $ET_{1-2}$.

During the programming period the scan signal $S_{SN1}$ is at a low level. Thus, the voltages stored in the pixel $P_{11}$~$P_{m1}$ of the first row are updated. During the programming period $PT_{1-2}$, the scan signal $S_{SN2}$ is at the low level. Thus, the voltages stored in the pixel $P_{12}$~$P_{m2}$ of the second row are updated. During the emission periods $ET_{1-1}$ and $ET_{1-2}$, each of the control signals $S_{CN1}$~$S_{cm}$, is at a high level, thus, the pixels $P_{11}$~$P_{mn}$ are activated to display brightness.

The invention does not limit how the voltages stored in the pixels $P_{11}$~$P_{mn}$ are updated. In this embodiment, when one of the scan signals $S_{SN1}$~$S_{SNn}$ is at a low level, the voltages stored in the pixels of a corresponding row are updated, but the disclosure is not limited thereto. In other embodiments, when one of the control signals $S_{CN1}$~$S_{CNn}$ is at a high level, the voltages stored in the pixels of a corresponding row are updated.

Similarly, in this embodiment, when the control signals $S_{CN1}$~$S_{cm}$, are at a high level, the pixels $P_{11}$~$P_{mn}$ are activated to display brightness. When the control signals $S_{CN1}$~$S_{CNn}$ are at a low level, the pixels $P_{11}$~$P_{mn}$ are de-activated to stop displaying brightness, however, the invention is not limited thereto. In other embodiments, when the control signals $S_{CN1}$~$S_{cm}$, are at a high level, the pixels $P_{11}$~$P_{mn}$ are de-activated to stop displaying brightness and when the control signals $S_{CN1}$~$S_{cm}$, are at a low level, the pixels $P_{11}$~$P_{mn}$ are activated to display brightness.

Figure 3:
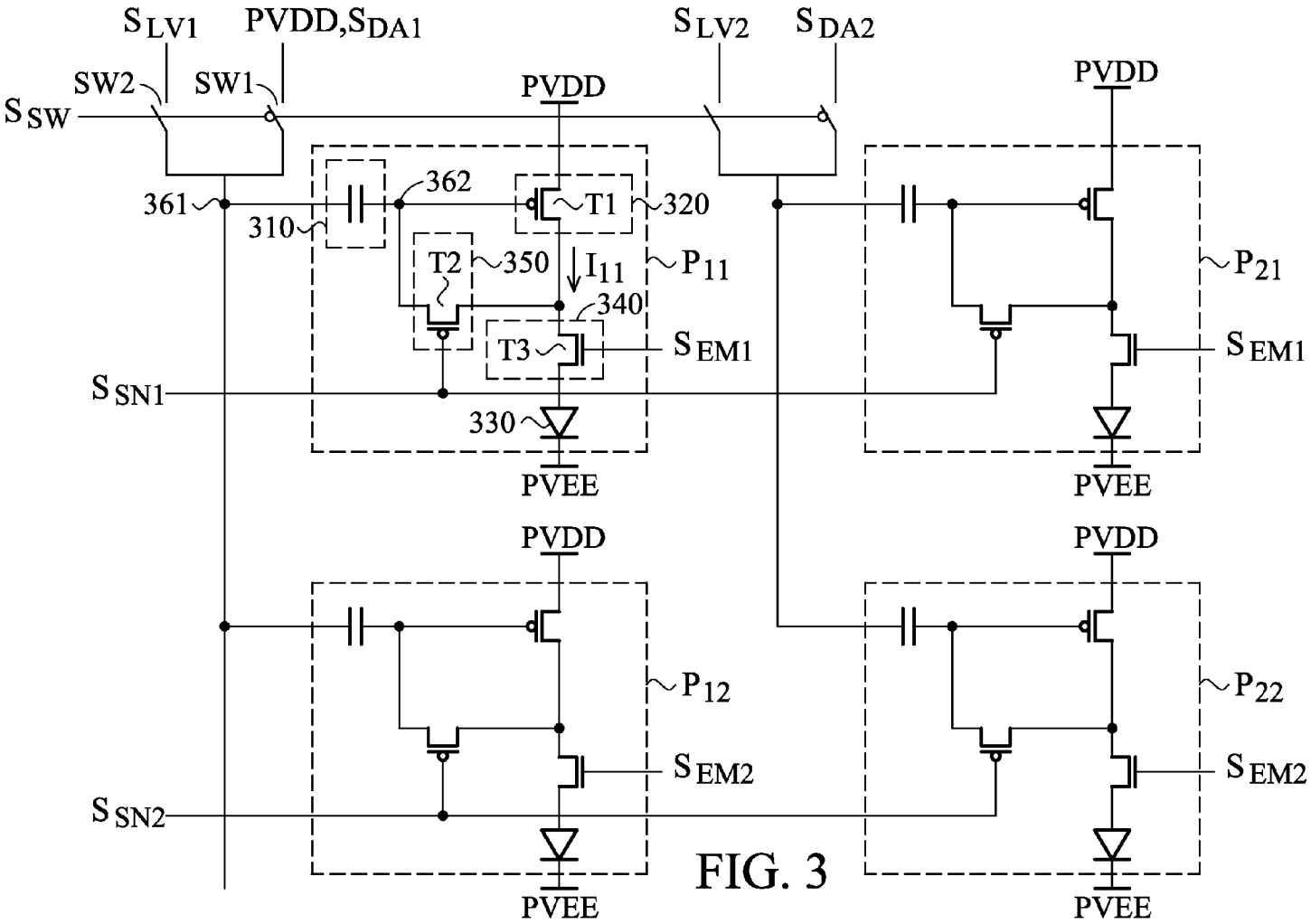
FIG. 3 is a schematic diagram of an exemplary embodiment of a pixel.

FIG. 3 is a schematic diagram of an exemplary embodiment of a pixel. For clarity, only pixels $P_{11}$, $P_{21}$, $P_{12}$ and $P_{22}$ are shown. Since the operations of the pixels $P_{11}$, $P_{21}$, $P_{12}$ and $P_{22}$ are the same, the pixel $P_{11}$ is given as an example. As shown in FIG. 3, the pixel $P_{11}$ comprises a storage unit 310, a driving unit 320, a luminescence unit 330, an emission unit 340 and a connection unit 350.

The storage unit 310 is coupled between the nodes 361 and 362. The node 361 receives an operation voltage PVDD or a data signal $S_{DA1}$ via a switch SW1. The invention does not limit the source of the operation voltage PVDD and the data signal $S_{DA1}$. In one embodiment, the operation voltage PVDD and the data signal $S_{DA1}$ are provided by the data driver 113. For example, the data driver 113 can transmit the operation voltage PVDD or the data signal $S_{DA1}$ to the node 361 via one or more metal lines (e.g. data lines).

Additionally, the node 361 receives a reference level $S_{LV1}$ via a switch SW2. The invention does not limit the source of the reference level $S_{LV1}$. In one embodiment, the reference level $S_{LV1}$ is provided by the data driver 113. In this embodiment, the storage unit 310 is a capacitor, but the disclosure is not limited thereto. In other embodiments, any device can serve as the storage unit 310, as long as the device is capable of storing voltage.

The driving unit 320 generates a driving current $I_{11}$ according to the voltage stored in the storage unit 310. The driving current $I_{11}$ is not interfered with a threshold voltage of the driving unit 320. In this embodiment, the driving unit 320 is a P-type transistor T1. The P-type transistor T1 comprises a gate coupled to the node 362, a source receiving the operation voltage PVDD and a drain coupled to the emission unit 340.

The luminescence unit 330 is lighted according to the driving current $I_{11}$. The invention does not limit the kind of the luminescence unit 330. In one embodiment, the luminescence unit 330 is an organic light emitting diode (OLED).

The emission unit 340 provides the driving current $I_{11}$ to the luminescence unit 330. In this embodiment, the emission unit 340 is an N-type transistor T3. The N-type transistor T3 comprises a gate receiving an emitting signal $S_{EM1}$, a drain coupled to a drain of the P-type transistor T1 and a source coupled to the luminescence unit 330. The invention does not limit the source of the emitting signal $S_{EM1}$. In one embodiment, the emitting signal $S_{EM1}$ is provided by the scan driver 111. In other embodiments, the emission unit 340 is a P-type transistor. Since the method for transformation between P-type and N-type transistors is well known to those skilled in the field, description thereof is omitted.

The connection unit 350 activates the driving unit 320 to form a diode connection. In this embodiment, the connection unit 350 is a P-type transistor T2. The P-type transistor T2 comprises a gate receiving the scan signal $S_{SN1}$, a source coupled to the node 362 and a drain coupled to the drain of the P-type transistor T1. In other embodiments, the connection unit 350 is an N-type transistor.

The driving module 110 controls the levels of the nodes 361 and 362 such that the driving current $I_{11}$ is not interfered with the threshold voltage of the P-type transistor T1. In this embodiment, the driving module 110 controls the scan signal $S_{SN1}$, the emitting signal $S_{EM1}$, the reference level $S_{LV1}$, the data signal $S_{DA1}$ and a switching signal $S_{SW}$ to turn on or off the transistors T1~T3 such that the levels of the nodes 361 and 362 are controlled. The operating principle of the driving module 110 is described in the following.

Figure 4:
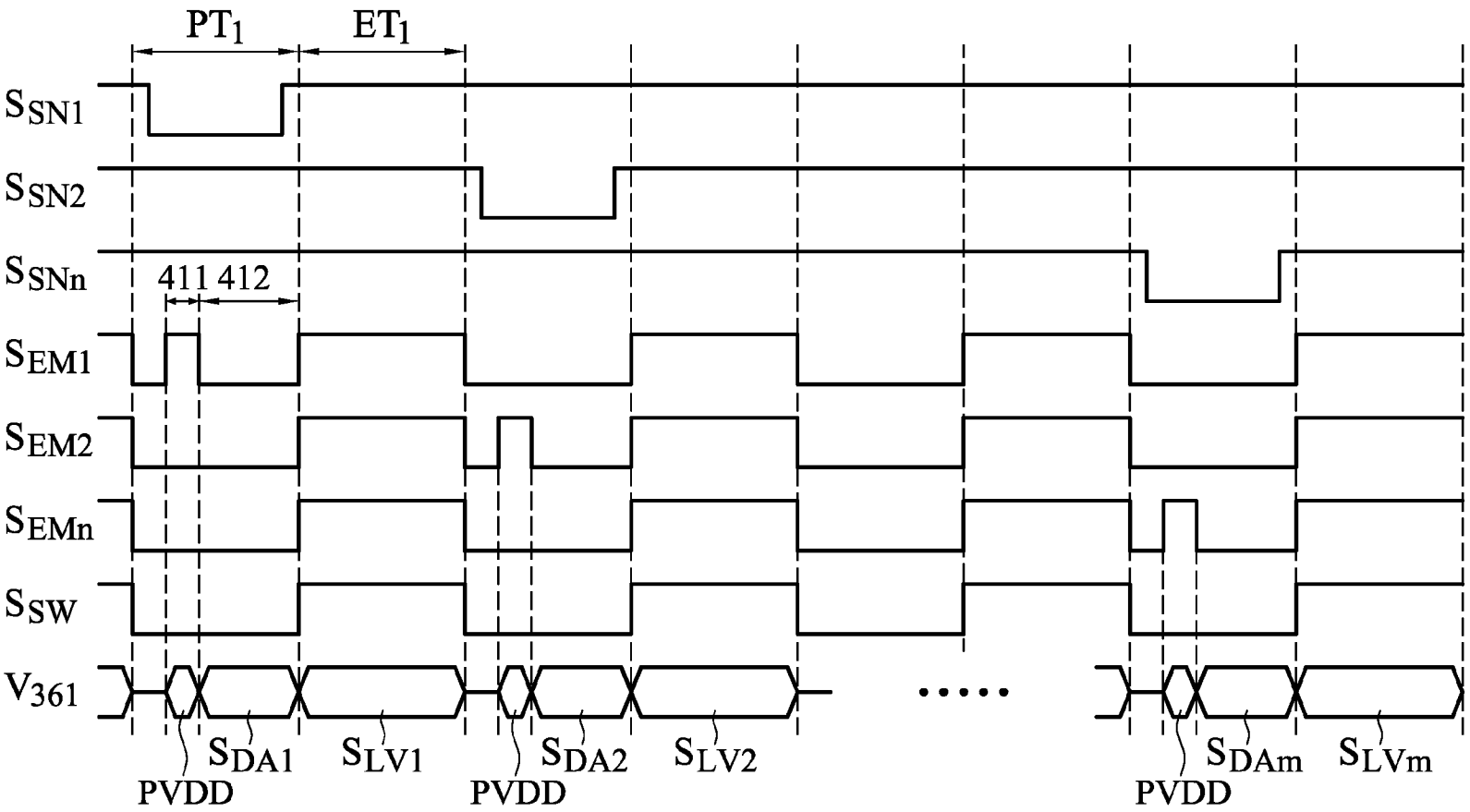
FIG. 4 is a timing schematic diagram of another exemplary embodiment of the pixel shown in FIG. 3.

First, the driving module 110 controls the level of the node 361 to be equal to the operation voltage PVDD and controls the scan signal $S_{SN1}$ and the emitting signal $S_{EM1}$ to turn on the transistors T2 and T3. In this embodiment (referring to FIG. 4), the programming period $PT_1$ comprises a reset period 411 and a write detection period 412.

During the reset period 411, the switching signal $S_{SW}$ is at a low level to turn on the switch SW1. At this time, the level of the node 361 is equal to the operation voltage PVDD. During the reset period 411, the scan signal $S_{SN1}$ is at a low level and the emitting signal $S_{EM1}$ is at a high level. Thus, the transistors T2 and T3 are turned on. At this time, the level of the node 362 is equal to a low level.

During the write detection period 412, the driving module 110 provides a data signal $S_{DA1}$ to the node 361 and controls the scan signal $S_{SN1}$ and the emitting signal $S_{EM1}$ to turn on the transistor T2 and to turn off the transistor T3. In this embodiment, the switching signal $S_{SW}$ is at the low level to turn on the switch SW1. At this time, the node 361 receives the data signal $S_{DA1}$. During the write detection period 412, the scan signal $S_{SN1}$ and the emitting signal $S_{EM1}$ are at the low level such that the transistor T2 is still turned on and the transistor T3 is turned off.

Since the transistor T2 is turned on, the gate of the transistor T1 is coupled to the drain of the transistor T1. Thus, a diode connection is formed by the transistor T1 and the level of the node 362 is equal to the sum of the operation voltage PVDD and the threshold voltage of the transistor T1.

During the emission period $ET_1$, the driving module 110 provides a reference level $S_{LV1}$ to the node 361 and controls the scan signal $S_{SN1}$ and the emitting signal $S_{EM1}$ to turn off the transistor T2 and turn on the transistor T3. In this embodiment, the switching signal $S_{SW}$ is at a high level. Thus, the switch SW2 is turned on to transmit the reference level $S_{LV1}$ to the node 361. At this time, the scan signal $S_{SN1}$ and the emitting signal $S_{EM1}$ are at a high level such that the transistor T2 is turned off and the transistor T3 is turned on.

Since the transistor T3 is turned on, the driving current $I_{11}$ is transmitted to the luminescence unit 330 to light the luminescence unit 330. The driving current $I_{11}$ is expressed by the following equation (1):

$$I_{11}=Kn*(V_{GS}-Vth)^2 \quad (1)$$

wherein Kn represents a parameter of the transistor $T_1$, $V_{GS}$ represents the voltage difference between the gate and the source of the transistor T1, and Vth represents the threshold voltage of the transistor T1.

During the emission period $ET_1$, since the level of the node 361 is changed from the data signal $S_{DA1}$ to the reference level $S_{LV1}$, the level of the node 362 is PVDD+Vth+$S_{LV1}$−$S_{DA1}$. If $V_{GS}$ in equation (1) is substituted for the voltage difference between the gate and the source of the transistor T1, the substituted result is expressed by the following equation (2):

$$I_{11}=Kn*(\text{PVDD}+\text{Vth}+S_{LV1}-S_{DA1}-\text{PVDD}-\text{Vth})^2 \quad (2)$$

If we simplify equation (2):

$$I_{11}=Kn*(S_{LV1}-S_{DA1}) \quad (3)$$

According to the equation (3), the driving current $I_{11}$ is not interfered with the threshold voltage of the transistor T1. Thus, when the threshold voltages of the transistors T1 of the pixels are not uniform, the uniform threshold voltages do not interfere with the brightness of all luminescence units.

Figure 5:
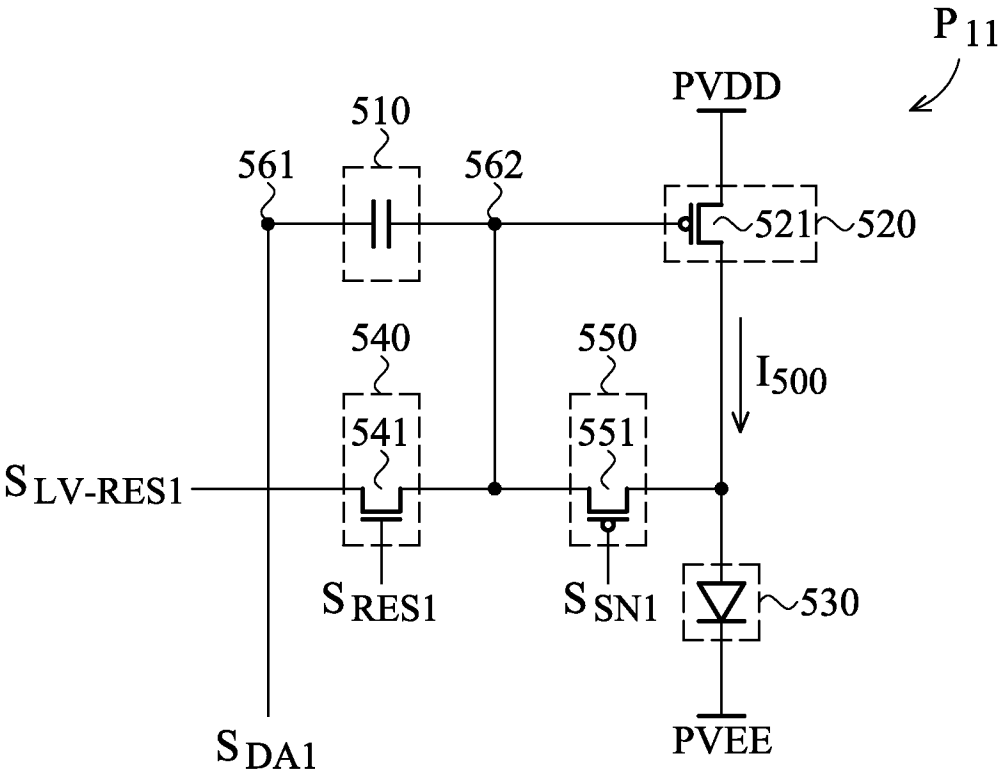
FIG. 5 is a schematic diagram of another exemplary embodiment of a pixel.

FIG. 5 is a schematic diagram of another exemplary embodiment of the pixel. Since the circuits of the pixels $P_{11}$~$P_{mn}$ are the same, the pixel $P_{11}$ is given as an example. The pixel $P_{11}$ comprises a storage unit 510, a driving unit 520, a luminescence unit 530, a reset unit 540 and a switching unit 550.

The storage unit 510 is coupled between the nodes 561 and 562. The driving unit 520 generates a driving current $I_{500}$ according to the voltage stored in the storage unit 510. In this embodiment, the driving unit 520 is a P-type transistor 521. The P-type transistor 521 comprises a gate coupled to the node 562, a source receiving the operation voltage PVDD and a drain coupled to the luminescence unit 530. In this embodiment, the driving current $I_{500}$ is not interfered with the threshold voltage of the driving unit 520.

The luminescence unit 530 is lighted according to the driving current $I_{500}$ and connected to the driving unit 520 in series between the operation voltages PVDD and PVEE. The reset unit 540 discharges the node 562. In this embodiment, the reset unit 540 is an N-type transistor 541. The N-type transistor 541 comprises a gate receiving a reset signal $S_{RES1}$, a drain receiving a reset level $S_{LV\text{-}RES1}$ and a source coupled to the node 562. The invention does not limit the sources of the reset signal $S_{RES1}$ and the reset level $S_{LV\text{-}RES1}$. In one embodiment, the reset signal $S_{RES1}$ is provided by the scan driver 111 and the reset level $S_{LV\text{-}RES1}$ is provided by the data driver 113.

The switching unit 550 is coupled to the node 562 and the driving unit 520. In this embodiment, the switching unit 550 is a P-type transistor 551. The P-type transistor 551 comprises a gate receiving the scan signal $S_{SN1}$, a source coupled to the node 562 and a drain coupled to the drain of the transistor 521.

In this embodiment, the driving module 110 utilizes the operation voltage PVDD, PVEE, the scan signal $S_{SN1}$, the reset signal $S_{RES1}$, the data signal $S_{DA1}$ and the reset level $S_{LV\text{-}RES1}$ to control the levels of the nodes 561 and 562 such that the driving current $I_{500}$ is not interfered with the threshold voltage of the driving unit 520. The operating principle of the driving module 110 is described in the following.

Figure 6:
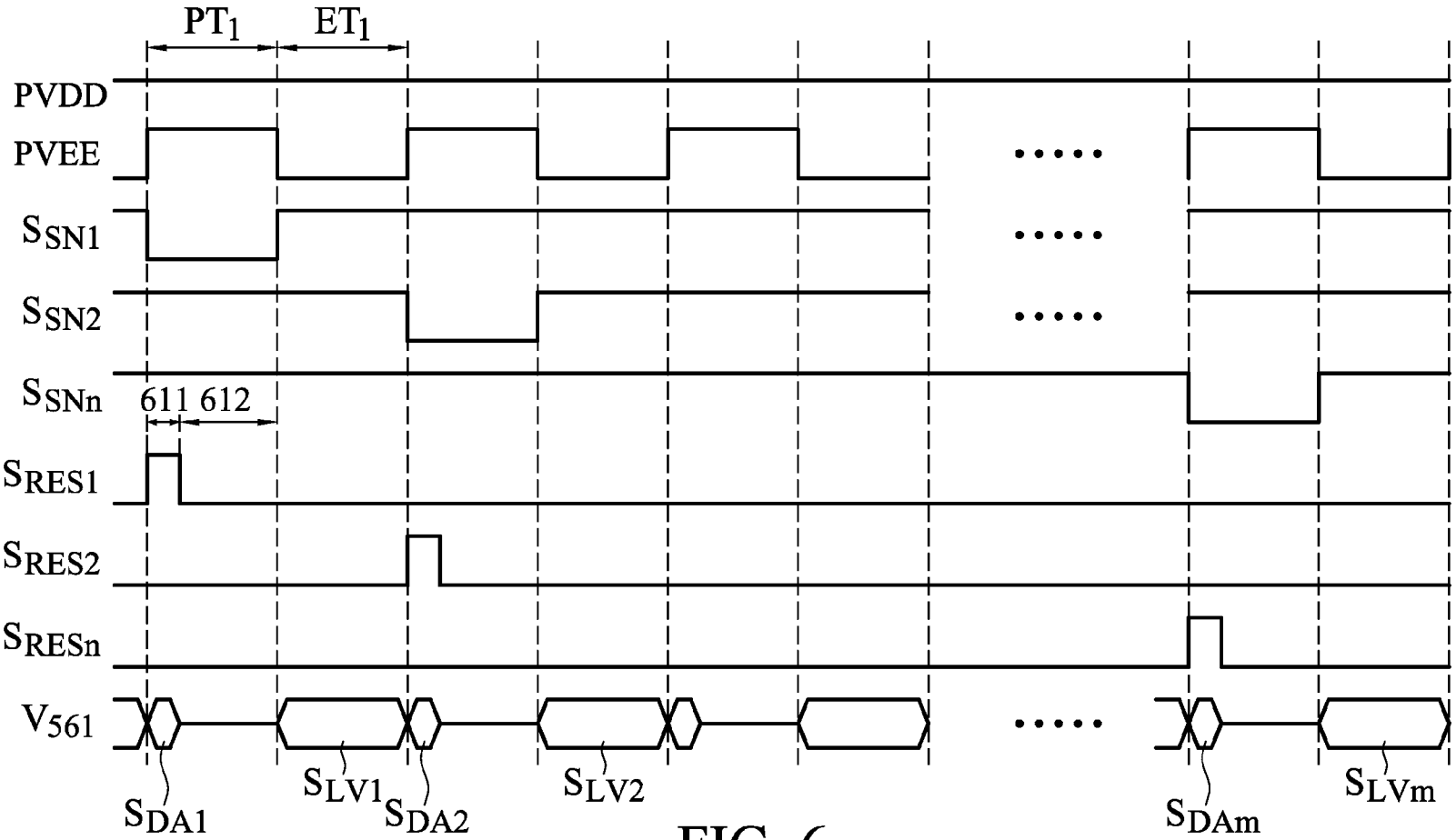
FIG. 6 is a timing schematic diagram of another exemplary embodiment of the pixel shown in FIG. 5.

Refer to FIG. 6, during a reset write period 611 of the programming period $PT_1$, the driving module 110 provides a data signal $S_{DA1}$ to the node 561 and controls the reset signal $S_{RES1}$ to turn on the transistor 541. In this embodiment, the reset signal $S_{RES1}$ is at a high level such that the transistor 541 is turned on. Thus, the level of the node 562 is equal to the reset level $S_{LV\text{-}RES1}$.

In this embodiment, the scan signal $S_{SN1}$ is at a low level such that the transistor 551 is turned on. In other embodiments, during the reset write period 611, the scan signal $S_{SN1}$ is at a high level to turn off the switching unit 550. Since the operation voltage PVEE is at a high level during the reset write period 611, the luminescence unit 530 is not lighted.

During the detection period 612, the driving module 110 maintains the level of the node 561 to be equal to the data signal $S_{DA1}$ and controls the reset signal $S_{RES1}$ and the scan signal $S_{SN1}$ to turn off the transistor 541 and turn on the transistor 551. In this embodiment, the reset signal $S_{RES1}$ is at a low level such that the transistor 541 is turned off. Since the scan signal $S_{SN1}$ is at the low level, the transistor 551 is turned on.

The transistor 551 is turned on to form a diode connection. Thus, the level of the node 562 is equal to the sum of the operation voltage PVDD and the threshold voltage of the transistor 521. At this time, since the operation voltage PVEE is at a high level, the luminescence unit 530 is not lighted.

During the emission period $ET_1$, the driving module 110 provides a reference level $S_{LV1}$ to the node 561 and controls the reset signal $S_{RES1}$ and the scan signal $S_{SN1}$ to turn off the transistors 541 and 551. Since the level of the node 561 is changed from the data signal $S_{DA1}$ to the reference level $S_{LV1}$, the level of the node 562 is equal to $PVDD+Vth+S_{LV1}-S_{DA1}$.

The invention does not limit the source of the reference level $S_{LV1}$. In one embodiment, the data driver 113 of the driving module 110 transmits the data signal $S_{DA1}$ or the reference level $S_{LV1}$ to the node 561 via one metal line during different periods.

In this embodiment, since the scan signal $S_{SN1}$ is at a high level, the transistor 541 is turned off. The reset signal $S_{RES1}$ is at a low level such that the transistor 551 is turned off. At this time, since the operation voltage PVEE is at a low level and the operation voltage PVDD is at a high level, the luminescence unit 530 is lighted.

Since the level of the node 561 is $PVDD+Vth+S_{LV1}-S_{DA1}$, when the transistor 521 generates the driving current $I_{500}$ according to the equation (1), the driving current $I_{500}$ is not interfered with the threshold voltage of the transistor 521.

Since all of the pixels are repeatedly lighted, a flicker issue does not occur in an image displayed by the display device and a user does not discover the flicker issue. Additionally, when the pixels are de-activated, the voltages stored in the pixels arranged corresponding to at least one row are updated. Thus, the display device can display correct images.

Furthermore, when the driving units of the pixels comprise various threshold voltages, the driving currents are not interfered with the various threshold voltages. Thus, if the pixels receive the same data signals, the pixels can display the same brightness.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a plurality of pixels, each storing voltage and displaying brightness according to the stored voltage, wherein each pixel comprises:

a storage unit storing voltage and coupled between a first node and a second node;

a driving unit generating a driving current according to the voltage stored in the storage unit, wherein the driving current is not interfered with a threshold voltage of the driving unit;

a luminescence unit lighting according to a driving current and connected to the driving unit in series between a first operation voltage and a second operation voltage;

a reset unit discharging the second node; and a switching unit coupled to the second node and the driving unit; and a driving module updating the stored voltage during a frame period, wherein the frame period comprises a plurality of row times, each row time comprises at least one programming period and at least one emission period, the driving module de-activates the pixels to stop displaying brightness during the programming periods and activates the pixels to display brightness during the emission periods, wherein the driving unit is a first transistor, and the first transistor comprises a gate coupled to the second node, a source receiving the first operation voltage and a drain coupled to the luminescence unit, wherein the reset unit is a second transistor, and the second transistor comprises a gate receiving a reset signal, a drain receiving a reset level and a source coupled to the second node, wherein the switching unit is a third transistor, and the third transistor comprises a gate receiving a scan signal, a source coupled to the second node and a drain coupled to a drain of the first transistor, wherein a first programming period among the programming period comprises a reset write period and a detection period, wherein during the reset write period, the driving module provides a data signal to the first node and controls the reset signal to turn on the second transistor, wherein during the detection period, the driving module controls a level of the first node to be equal to a level of the data signal and controls the reset signal and the scan signal to turn off the second transistor and to turn on the third transistor, wherein during the emission period, the driving module provides a reference level to the first node and controls the reset signal and the scan signal to turn off the second and the third transistors, and wherein during the reset write period, the driving module controls the scan signal to turn on the third transistor.

2. The display device as claimed in claim 1, wherein a first row time among the row time comprises a first programming period and a first emission period, and the first programming period occurs before the first emission period.

3. The display device as claimed in claim 1, wherein a first row time among the row time comprises a first programming period, a second programming period, a first emission period and a second emission period, wherein the first programming period occurs before the second programming period, the second programming period occurs before the first emission period and the first emission period occurs before the second emission period.

4. The display device as claimed in claim 1, wherein during a first programming period among the programming periods, a first portion of the pixels is updated by the driving module, during a second programming period among the programming periods, a second portion of the pixels is updated by the driving module, wherein the first portion of the pixels is coupled to a first scan electrode and the second portion of the pixels is coupled to a second scan electrode.

5. The display device as claimed in claim 1, wherein during the reset write period, the driving module controls the scan signal to turn off the third transistor.

6. The display device as claimed in claim 1, wherein during the programming periods, the driving module controls a level of the second operation voltage to be equal to a first level such that the luminescence unit is not lighted, and during the emission period, the driving module controls a level of the second operation voltage to be equal to a second level such that the luminescence unit is lighted.

7. The display device as claimed in claim 1, wherein the luminescence unit is an organic light emitting diode (OLED).

8. A control method for a plurality of pixels, wherein each pixel comprises a storage unit, a driving unit, a luminescence unit, a reset unit, and a switching unit, wherein the storage unit stores voltage and is coupled between a first node and a second node, the driving unit generates a driving current according to the voltage stored in the storage unit, the driving current is not interfered with a threshold voltage of the driving unit, the luminescence unit lights according to the driving current and is connected to the driving unit in series between a first operation voltage and a second operation voltage, the reset unit discharges the second node, the switching unit is coupled to the second node and the driving unit, the driving unit is a first transistor, the first transistor comprises a gate coupled to the second node, a source receiving the first operation voltage, and a drain coupled to the luminescence unit, the reset unit is a second transistor, the second transistor comprises a gate receiving a reset signal, a drain receiving a reset level, and a source coupled to the second node, the switching unit is a third transistor, and the third transistor comprises a gate receiving a scan signal, a source coupled to the second node and a drain coupled to a drain of the first transistor, comprising:

during a frame period, updating voltages of the pixels, wherein the frame period comprises a plurality of row times, and each row time comprises at least one programming period and at least one emission period;

during the programming periods, de-activating the pixels to stop displaying brightness; and during the emission period, activating the pixels to display brightness, wherein a first programming period among the programming period comprises a reset write period and a detection period, wherein during the reset write period, the driving module provides a data signal to the first node and controls the reset signal to turn on the second transistor, wherein during the detection period, the driving module controls a level of the first node to be equal to a level of the data signal and controls the reset signal and the scan signal to turn off the second transistor and to turn on the third transistor, wherein during the emission period, the driving module provides a reference level to the first node and controls the reset signal and the scan signal to turn off the second and the third transistors, and wherein during the reset write period, the driving module controls the scan signal to turn on the third transistor.

9. The control method as claimed in claim 8, wherein a first row time among the row times comprises a first programming period and a first emission period, and the first programming period occurs before the first emission period.

10. The control method as claimed in claim 8, wherein a first row time among the row times comprises a first programming period, a second programming period, a first emission period and a second emission period, and wherein the first programming period occurs before the second programming period, the second programming period occurs before the first emission period, and the first emission period occurs before the second emission period.

11. The control method as claimed in claim 8, wherein during a first programming period among the programming periods a first portion of the pixels is updated, during a second programming period among the programming periods, a second portion of the pixels is updated, and wherein the first portion of the pixels is coupled to a first scan electrode and the second portion of the pixels is coupled to a second scan electrode.

* * * * *